US006971248B1

(12) United States Patent
Wiggs

(10) Patent No.: US 6,971,248 B1
(45) Date of Patent: Dec. 6, 2005

(54) METHOD AND APPARATUS FOR INHIBITING ICE ACCUMULATION IN HVAC SYSTEMS

(76) Inventor: B. Ryland Wiggs, 214 Overlook Ct., Suite 160, Brentwood, TN (US) 37027

( * ) Notice: Subject to any disclaimer, the term of this patent is extended or adjusted under 35 U.S.C. 154(b) by 166 days.

(21) Appl. No.: 10/073,515

(22) Filed: Feb. 11, 2002

(51) Int. Cl.[7] ..... F25D 21/00
(52) U.S. Cl. ..... 62/272; 165/47
(58) Field of Search ..... 62/272, 282; 165/47, 165/95, 133, 134.1, DIG. 512, DIG. 514

(56) References Cited

U.S. PATENT DOCUMENTS

| | | | | |
|---|---|---|---|---|
| 4,536,765 | A * | 8/1985 | Kaminski | 343/704 |
| 5,199,486 | A * | 4/1993 | Balmer et al. | 165/47 |
| 5,419,135 | A | 5/1995 | Wiggs | |
| 5,623,986 | A | 4/1997 | Wiggs | |
| 5,725,047 | A * | 3/1998 | Lopez | 165/149 |
| 5,946,928 | A | 9/1999 | Wiggs | |
| 2002/0132947 | A1 * | 9/2002 | Smith et al. | 526/247 |

FOREIGN PATENT DOCUMENTS

JP 020001080058 A * 4/2000

* cited by examiner

*Primary Examiner*—Melvin Jones
(74) *Attorney, Agent, or Firm*—Waddey and Patterson, P.C.; Mark J. Patterson; Howard H. Bayless

(57) ABSTRACT

A non-stick coating, which inhibits frozen moisture accumulation, is applied to exterior exposed portions of heating and cooling systems where ice or other frozen moisture can accumulate and impair system design operational efficiencies; where heat exchange tubing and fins are downwardly sloped or angled; with an optional protective shell encasement which can be shaped to provide a vena contracta effect; with an optional electric fan to enhance airflow for heat exchange; with an optional electric vibrator to enhance inhibition of frozen moisture accumulation; with a downwardly sloped base to direct falling frozen moisture away from the heat exchange equipment; for use in conjunction with an air source heat pump system, an evaporative cooling system or a chiller, or as a supplement to a water-source heat pump system or to a direct expansion heat pump system; and for use with any other refrigerant-based heating system or cooling system.

23 Claims, 1 Drawing Sheet

METHOD AND APPARATUS FOR INHIBITING ICE ACCUMULATION IN HVAC SYSTEMS

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

The invention relates to the field of refrigerant-based heating and cooling systems, and to evaporative cooling systems, and more particularly to a system designed to inhibit condensation or other frozen moisture accumulation on heat exchange equipment or tubing, which tubing is typically finned, and which equipment or tubing is exposed to the air, by means of the application of a non-stick coating to the exterior portion of such air-exposed equipment or tubing, or finned tubing, or the like.

Virtually all heating and cooling systems utilize equipment or a heat exchange means which periodically is exposed to air containing moisture, or water vapor. For example, well-known air source heat pump systems typically utilize exterior heat exchange units consisting of finned copper tubing, which tubing transports a refrigerant such as R22 or the like, with an electric fan utilized to blow air over the finned tubing to accelerate heat transfer from the warm air to the cold refrigerant fluid in the heating mode, and from the hot refrigerant fluid to the cool air in the cooling mode. Such a system also typically incorporates an interior air heat exchange unit comprised of finned copper tubing and an electric fan, a compressor which is used to both compress the refrigerant vapor and to circulate the refrigerant fluid through the system, an expansion valve, and other miscellaneous parts and optional apparatus, well known in the field, depending on the particular design.

While copper is generally utilized for heat transfer tubing in most common refrigerant-based systems applications, other materials, such as titanium or the like, may also be utilized for heat transfer tubing, just as various other system components may vary. Also, in large commercial chillers, plastic tubing is commonly utilized to transport water for evaporative cooling purposes, which water has typically been heated from waste heat augmented by heat of compression from a refrigerant-based heat transfer system.

However, when typical air-source heat pump systems are operating in the heating mode, since the refrigerant fluid, which is being circulated into the exterior outdoor heat exchange unit exposed to the air, is typically below the freezing point of water, as the exterior air temperature approaches, or falls below, the freezing point of water, humidity in the air collects on the finned tubing and is frozen. This freezing humidity gradually builds up ice accumulations to the extent that it blocks the airflow designed to pass over the finned tubing, thereby rendering the system unable to acquire sufficient heat from the air to operate at design levels. Consequently, a defrost cycle is commonly utilized to remove the ice when the accumulation becomes excessive. The defrost cycle for a residential air source heat pump system typically lasts for about eight minutes, and actually consists of operating the heat pump system in the cooling mode, so as to run hot refrigerant fluid through the exterior finned tubing to melt the ice. As the heat pump system is operating in the cooling mode during the defrost cycle, heat is being taken from the interior air via the interior heat exchange unit, which heat is typically replaced via electric resistance heat or via a fossil fuel means. This periodic defrost cycle results in excessive wear and tear on the compressor, tending to shorten compressor life, as well as in lowered system efficiencies and higher operational costs.

There have been many attempts to make the defrost cycle more efficient, such as using more efficient equipment designs, using stored energy to heat the refrigerant fluid used in the defrost cycle, and the like. However, there remains a need to provide a means to eliminate the necessity for a defrost cycle in an air source heat pump system, and to eliminate unwanted ice accumulations, whether from condensation ice, freezing rain, snow, or hail, on the exterior portion of any refrigerant-based heat transfer system part, whether commercial or residential, resulting from an accumulation of frozen moisture.

Similarly, in large commercial evaporative cooling chillers, which must periodically operate in below freezing temperatures, and which sometimes must operate with a cooling load significantly less than called for by system design, the water utilized for evaporative cooling on the exterior of the heat transfer tubing may freeze. Consequently, under such conditions, there is a similar need to provide an efficient means to eliminate the necessity for a costly de-icing operation.

SUMMARY OF THE INVENTION

It is an object of the invention to provide a means to inhibit ice accumulations on system component areas of any refrigerant-based heat transfer system or evaporative cooling system where accumulated frozen moisture, such as frozen humidity, frozen rain, snow, or hail, would decrease system operational design efficiencies for any reason. One such decrease in system operational efficiencies, for example, would be the necessity for an air-source heat pump system to operate in a defrost mode.

This objective is accomplished by means of applying a non-stick coating to the exterior portion of any refrigerant-based or evaporative cooling based heating or cooling system where undesirable ice accumulation could occur. The non-stick coating will prevent ice from adhering to the exterior finned heat transfer tubing, or to any other air-exposed system surface areas desired. In turn, this will provide advantages such as eliminating the need for a defrost or a de-icing cycle, increasing system operational efficiencies, and decreasing system operational costs.

The non-stick coating may be composed of any substance which will inhibit or prevent ice from adhering to the exterior surface of the portion of the refrigerant-based heating or cooling system desired to be protected. When applied to the exterior surface of a heat transfer area, such as the outdoor finned copper tubing on an air source heat pump, the substance should be of a type that does not, or does not significantly, impede heat transfer in an insulating fashion. Such a non-stick coating may be composed of a substance such as a tetrafluoroethylene resin Teflon®, such as DuPont Teflon® PFA, having a thickness coating of about 0.003 to 0.004 inches, or such as a fluoropolymer dip coating. Another example of such a non-stick coating may consist of plasma-polymerizing a fluoroethylene monomer, such as tetrafluoroethylene, in the presence of the desired exterior surface and depositing a fluoropolymer coating of about 1/10,000 inch or less on the exterior surface. Another example of such a non-stick coating may be a triazine-dithiol derivative, or the like.

While the object of the invention is to eliminate the need for a defrost cycle or other ice removal means from refrigerant-based heating and cooling systems and from evaporative cooling systems, certain non-stick coatings may tend to actually enhance thermal conductivity, as taught in U.S. Pat. No. 5,419,135 to Wiggs. Although the purpose of this invention is not to teach an exterior coating method to improve thermal conductivity, the utilization of such a coating, which also provides a non-stick surface for ice, would be of some ancillary advantage and therefore non-stick coatings of this nature would be preferable to utilize for the purposes of this invention. While any particular non-stick coating applied may also inhibit the collection of water or other substances, such inhibition alone is of no value if the non-stick coating does not inhibit the accumulation of ice, which is the purpose of this invention. Other such appropriate non-stick coatings are well known by those in the industry and may continue to be developed.

While the operation of an electric fan alone may blow away any thin film of humidity induced condensation ice, or other form of frozen water, which has not fallen by operation of gravity, from the non-stick exterior air heat exchange coils of a conventional air-source heat pump when operating in the heating mode in the winter, a problem with ice removal could still exist if the fins, for expanded air surface contact connected to the refrigerant conductive tubing, are too closely spaced or are horizontally oriented. To achieve a more reliable ice removal method, in conjunction with the non-stick surface coating, a fin design should be utilized whereby the fins are sloped, or are spiraled, downwardly, or are in a vertical position such that the fins extend in a substantially parallel direction to the longitudinal axis of the tubes transporting the refrigerant fluid, so that gravity alone will pull off any ice forming on the non-stick surface.

By applying a non-stick coating to the exterior air heat exchange unit, with an oversized array of downwardly or vertically sloped fins, which fins serve to increase the surface area exposed to the air, the electric fan on a conventional air-source heat pump system can be either reduced in size or eliminated on the exterior air heat exchange unit, thereby creating enhanced operational efficiencies. In such an enhanced efficiency design, the non-stick coated finned tubing in the exterior air heat exchange unit may be surrounded with a protective shell, which would also be coated with a non-stick coating, with flared openings at the top and at the bottom so as to create a natural vena contracta effect. Thus, as the heat is transferred into the exterior air in the cooling mode, since hot air rises, the natural upward flow will pull cooler outside air in from the bottom, thereby creating a natural air flow over the non-stick coated finned tubing. In the heating mode, since air from which heat is extracted becomes cooler and heavier, the cooled air will naturally fall and will pull warmer air in from the top, again creating a natural air flow. Because of this naturally induced air flow, the conventionally used electric fan can be either eliminated or reduced in size, thereby increasing system operational efficiencies.

The exterior non-stick coated air heat exchange unit must be sufficiently elevated so as to allow falling ice to accumulate underneath the unit without building up from below so as to hamper the heat exchange ability of the refrigerant system. Further, the exterior unit should be furnished with a non-stick coated downwardly sloped base, cone-shaped base, or the like, so falling ice will slide harmlessly to the side, at a sufficient distance away from the unit to avoid any airflow obstruction or any other decrease in system operational efficiencies. Additionally, the exterior unit may be equipped with an optional vibrator, which may be programmed to periodically vibrate the finned heat exchange tubing as appropriate, to further enhance the ability of the non-stick surface coating to remove any ice, or other frozen moisture, build-up. The electrical power required to periodically operate a relatively small vibrator is significantly less than the power required by a conventional defrost cycle.

The exterior non-stick coated air heat exchange unit can be used with or without an electric fan, and with or without a protective shell. The unit can be used with an air-to-air heat pump system, can be used as a supplement to an open loop or a closed loop water-source heat pump system, can be used as a supplement to a direct expansion heat pump system such as those described in U.S. Pat. Nos. 5,623,986 and 5,946,928 to Wiggs, can be used in a commercial evaporative cooling system, or can be used in any other application apparent to those skilled in the trade.

BRIEF DESCRIPTION OF THE DRAWINGS

There are shown in the drawings embodiments of the invention as presently preferred. It should be understood, however, that the invention is not limited to the exemplary arrangements and instrumentalities shown in the drawings, wherein.

DESCRIPTION OF THE PREFERRED EMBODIMENTS

A method and apparatus for inhibiting condensation ice accumulation on heat transfer systems, including refrigerant-based heating and cooling systems, and on an evaporative cooling system, according to the invention, utilizes a non-stick coating applied to heat exchange components and other exterior surface areas of the refrigeration system where ice accumulation is not desirable because such ice decreases overall system operational efficiencies. Additionally, according to the invention, a certain design for outdoor air heat exchange means, and an optional vibrator, enhance the ability to eliminate condensation ice build-up.

Figure 1:
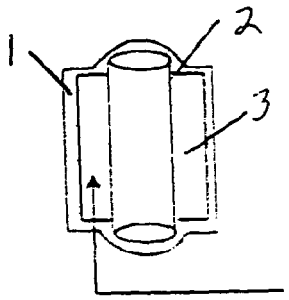
FIG. 1 is a side view of a segment of a vertically finned fluid transport tubing with a non-stick exterior coating applied in accordance with the present invention.

In one embodiment of the invention, as shown via a side view in FIG. 1, not drawn to scale, a heat exchange component of a heat transfer system is shown. The heat exchange component is a segment of fluid (such as refrigerant fluid) transport tubing 2 with two exterior expanded surface area heat transfer fins 3 in thermal contact with, and arranged in a vertical position parallel to the longitudinal axis of, the tubing 2, as conventionally found in refrigerant-based heating and air conditioning systems. An ice, or other frozen moisture, inhibiting non-stick coating 1 is preferably applied to the exterior heat exchange surfaces of the transport tubing 2 and/or the heat transfer fins 3.

Figure 2:
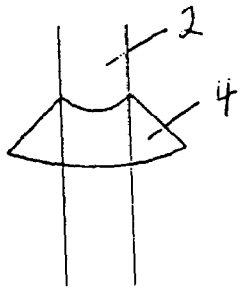
FIG. 2 is a side view of a downwardly sloped heat transfer fin.

Preferably, the heat exchange components are oriented to promote gravity flow of ice away from the component. Thus, FIG. 2 is a side view of a downwardly sloped heat transfer fin 4, which surrounds a fluid transport tubing 2 segment with a vertically oriented longitudinal axis, all coated with a non-stick coating 1 as seen in FIG. 1.

Figure 3:
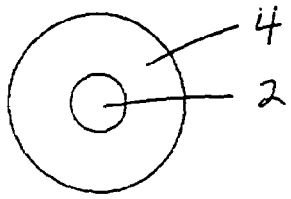
FIG. 3 is a top view of a downwardly sloped heat transfer fin.

FIG. 3 is a top view of a downwardly sloped heat transfer fin 4, which surrounds a fluid transport tubing 2 segment, all coated with a non-stick coating 1 as seen in FIG. 1.

Figure 4:
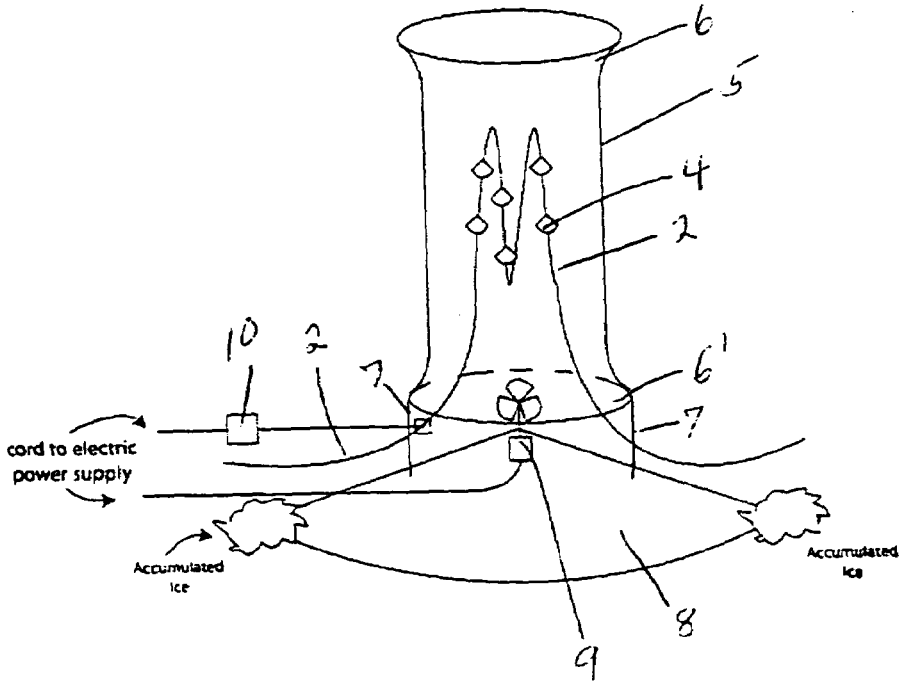
FIG. 4 is a schematic view of primarily vertically oriented, downwardly sloped finned, fluid transport tube, with a protective outer shell shaped to provide a vena contracta air flow effect, with a cone-shaped base to remove falling ice by operation of gravity with an optional electric fan to enhance airflow, and with an optional electric vibrator to enhance the inhibition of frozen moisture accumulation, all covered with a non-stick coating.

FIG. 4 is a schematic view of a primarily vertically oriented fluid transport tube 2, with attached surrounding and downwardly sloped heat transfer fins 4, shown entering and exiting a protective outer shell 5. Preferably, the shell 5 is shaped to promote convection air flows through the shell. Thus, in the embodiment of FIG. 4, a vena contracta shaped shell 5 has an outwardly flared top 6 and bottom portion 6', with the protective shell 5 supported and elevated by legs 7. A cone-shaped base 8, with a wall that slopes downwardly and outwardly, is centered under the protective outer shell 5, with an optional electric fan 9 to enhance heat transfer and ice removal, and with an optional vibrator 10 attached to at least one of the fluid transport tubes 2, with all exterior components coated with a non-stick coating 1 (not shown). As shown in FIG. 4, the base 8 and shell 5 are shaped to direct falling ice accumulations outwardly so as not to inhibit air flow through the system. Preferably, the exposed surfaces of the fan 9 and vibrator 10 are coated with a no-stick material as well.

The non-stick coating may be composed of any substance which will inhibit or prevent ice from adhering to the exterior surface of the portion of the refrigerant-based heating or cooling system desired to be protected. When applied to the exterior surface of a heat transfer area, such as the outdoor finned copper tubing on an air source heat pump, the substance should be of a type that does not, or does not significantly, impede heat transfer in an insulating fashion. Such a non-stick coating may be composed of a substance such as a tetrafluoroethylene resin (PTFE) Teflon®, such as DuPont Teflon® PFA, having a thickness coating of about 0.003 to 0.004 inches, or such as a fluroropolymer dip coating. Another example of such a non-stick coating may consist of plasma-polymerizing a fluoroethylene monomer, such as tetrafluoroethylene, in the presence of the desired exterior surface and depositing a fluoropolymer coating of about 1/10,000 inch or less on the exterior surface. Another example of such a non-stick coating may be a triazine-dithiol derivative, or the like.

In one embodiment of the system, a heat exchange component provided with a non-stick coating as described herein is incorporated into a direct expansion geothermal heat exchange system. Such systems are known in the art and are shown, for example, in U.S. Pat. Nos. 5,623,986 and 5,946,928, both issued to Wiggs, the disclosures of which are incorporated herein in their entirety. For example, a heat exchange system as shown in FIG. 4 can be incorporated into the direct expansion geothermal heat exchange system at a point just before the refrigerant enters the subterranean heat exchanger.

Thus, although there have been described particular embodiments of the present invention of a new and useful Method and Apparatus for Inhibiting Ice Accumulation in HVAC Systems, it is not intended that such references be construed as limitations upon the scope of this invention except as set forth in the following claims.

What is claimed is:

1. A heat transfer system adapted for operation in a heating mode without periodic operation in a defrost cycle, said system comprising:

a heat exchanger including a heat exchange surface having at least one fin affixed to said heat exchange surface, said heat exchanger adapted for immersion in a moisture laden atmosphere, said heat exchanger adapted for operation in said heating mode whereby a working fluid having a temperature less than the freezing point of water in said moisture laden atmosphere is flowed through the heat exchanger so as to promote the adherence of frozen moisture to the heat exchange surface; and a non-stick coating applied to the heat exchange surface including at least one said fin, the non-stick coating adapted to inhibit adherence of frozen moisture to the heat exchange surface.

2. The heat transfer system of claim 1 wherein the heat exchanger comprises refrigerant tubing having heat transfer fins in thermal contact with the refrigerant tubing.

3. A heat transfer system comprising:

a heat exchange component having a finned heat exchange surface adapted for immersion in a moisture laden atmosphere wherein, the heat exchange component comprises fluid transfer tubing having heat transfer fins in thermal contact with the fluid transfer tubing; and a non-stick coating applied to the heat exchange surface, the non-stick coating adapted to inhibit adherence of frozen moisture to the heat exchange surface, wherein the fluid transfer tubing and heat transfer fins are oriented to promote gravity flow of frozen moisture away from the heat exchange component.

4. A heat transfer system comprising:

a heat exchange component having a finned heat exchange surface adapted for immersion in a moisture laden atmosphere and a non-stick coating applied to the heat exchange surface, the non-stick coating adapted to inhibit adherence of frozen moisture to the heat exchange surface; and a protective shell positioned around the heat exchange component, the protective shell also having non-stick coating adapted to inhibit the adherence of frozen moisture to the shell.

5. A heat transfer system comprising:

a heat exchange component having a heat exchange surface;

a non-stick coating applied to the heat exchange surface, the non-stick coating adapted to inhibit adherence of frozen moisture to the heat exchange surface; and a protective shell positioned around the heat exchange component, the protective shell also having non-stick coating adapted to inhibit the adherence of frozen moisture to the shell, wherein the protective shell is shaped to enhance convection air flows through the shell and around the heat exchange component.

6. The heat transfer system of claim 5 wherein the protective shell further comprises outwardly flared top and bottom portions.

7. A heat transfer system comprising:

a heat exchange component having a heat exchange surface;

a non-stick coating applied to the heat exchange surface, the non-stick coating adapted to inhibit adherence of frozen moisture to the heat exchange surface; and a fan positioned proximate the heat exchange component.

8. The heat transfer system of claim 7 wherein exposed surfaces of the fan are coated with a non-stick coating.

9. A heat transfer system comprising:

a heat exchange component having a heat exchange surface;

a non-stick coating applied to the heat exchange surface, the non-stick coating adapted to inhibit adherence of frozen moisture to the heat exchange surface; and a vibrator operatively connected to the heat exchange component to promote release of frozen moisture from the heat exchange surface.

10. The heat transfer system of claim 9 wherein exposed surfaces of the vibrator are coated with a non-stick coating.

11. A heat transfer system comprising:

a heat exchange component having a heat exchange surface;

a non-stick coating applied to the heat exchange surface, the non-stick coating adapted to inhibit adherence of frozen moisture to the heat exchange surface; and a base positioned below the heat exchange component, the base sloped downwardly and outwardly to direct frozen moisture accumulations away from the heat exchange component, the base provided with a non-stick coating adapted to inhibit adherence of frozen moisture.

12. In a heat exchange system such as an air-source heat pump system, an open loop or closed loop water-source heat pump system, a direct expansion heat pump system, or an evaporative cooling system, the heat exchange system comprising a refrigerant flowing through a heat exchanger having at least one finned tubing segment, each tubing segment having a finned heat transfer surface, said heat exchanger adapted for immersion in a moisture laden atmosphere such that operation of said heat exchange system in a heating mode tends to cause condensation of frozen moisture in the vicinity of the finned heat transfer surface, an improvement comprising a non-stick coating applied to the finned heat transfer surfaces so as to inhibit adherence of frozen moisture.

13. A method of inhibiting ice accumulation on an air-exposed heat transfer surface of a heat exchanger in a heat exchange system comprising the steps of:

(a) providing a heat exchange system comprising a refrigerant flowing through a heat exchanger having at least one finned tubing segment, each tubing segment having a finned heat transfer surface, said heat exchanger adapted for immersion in a moisture laden atmosphere such that operation of said heat exchange system in a heating mode tends to cause condensation of frozen moisture in the vicinity of the finned heat transfer surface;

(b) coating at least one heat transfer surface with a non-stick material so as to inhibit adherence of frozen moisture.

14. The method of claim 13 wherein the non-stick material comprises PTFE.

15. A method of inhibiting ice accumulation on an exposed heat transfer surface of a heat exchange component in a heat exchange system comprising coating the heat transfer surface with a fluoropolymer dip coating.

16. The method of claim 13 wherein the non-stick material comprises a triazine-dithiol derivative.

17. An atmospheric heat exchange system comprising:

a fluid transfer tubing adapted for immersion in a moisture laden atmosphere, the fluid transfer tubing formed into a heat exchanger array having fluid transfer tubing segments with generally non-horizontal slopes so as to remove moisture and frozen moisture by gravity flow, wherein the fluid transfer tubing segments are disposed within the heat exchanger array so as to reduce the amount of moisture or frozen moisture shed from any fluid transfer tubing segment that falls onto another fluid transfer tubing segment;

a refrigerant fluid flowed into the heat exchanger array, the refrigerant fluid having a temperature at or below the freezing temperature of moisture carried by the atmosphere; and a non-stick coating applied to the fluid transfer tubing, the non-stick coating adapted to inhibit adherence of moisture and frozen moisture to the fluid transfer tubing.

18. The heat exchanger of claim 17 further comprising:

heat transfer fins in thermal contact with the fluid transfer tubing, the non-stick coating further applied to the heat transfer fins.

19. The heat exchanger of claim 18 wherein the heat transfer fins are oriented so as to remove moisture and frozen moisture by gravity flow in a manner that minimizes the shedding of moisture and frozen moisture from one portion of the fluid transfer tubing onto another portion of the fluid transfer tubing.

20. The heat exchanger of claim 19 wherein the heat exchanger array comprises a generally helical spiral of fluid transfer tubing oriented along a generally horizontal axis.

21. In a refrigerant system having at least one refrigerant coil, wherein operation of said refrigerant system includes transferring heat from a moisture laden atmosphere to a chilled refrigerant flowed through said refrigerant coil, said refrigerant sufficiently chilled so as to promote accumulation of frozen moisture upon said refrigerant coil, an improvement comprising a non-stick coating applied to the refrigerant coil so as to generally inhibit accumulation of frozen moisture upon said refrigerant coil.

22. A heat transfer system comprising a heat exchange component having a heat exchange surface, wherein, said heat transfer system is adapted for selected operation in a heating mode, said operation in a heating mode including a period of operation in a heating cycle, wherein, operation in said heating cycle includes transferring heat from a moisture laden atmosphere to a chilled working fluid flowed through said heat exchange component, operation in said heating cycle tending to promote accumulation of frozen moisture upon said finned heat exchange surface, wherein, an accumulation of frozen moisture upon said heat exchange surface inhibits heating cycle operation, and wherein, said heating and cooling system further comprises a fluoropolymer material applied to the heat exchange surface, the fluoropolymer material creating a non-stick heat exchange surface that sheds frozen moisture whereby said heating system operating in the heating mode will generally operate in heating cycle operation without accumulation of frozen moisture upon the heat exchange surface.

23. A heat transfer system comprising:

a refrigerant;

a heat exchanger having a heat exchange surface, said refrigerant being flowed through said heat exchanger; and a fluoropolymer material applied to said heat exchange surface, wherein, said heat transfer system is adapted for selected operation in a heating mode, said operation in a heating mode including periodic heating cycle operation, such heating cycle operation including transferring heat from a moisture laden atmosphere to said refrigerant, said refrigerant being chilled sufficiently to generally promote accumulation of frozen moisture upon said heat exchange surface, wherein, an accumulation of frozen moisture upon said heat exchange surface inhibits heating cycle operation, wherein, said operation in a heating mode further includes such periods of defrost cycle operation to remove such frozen moisture as may accumulate during a preceding period of heating cycle operation, such defrost cycle operation precluding heating cycle operation, and wherein, said fluoropolymer material provides a non-stick coating creating a non-stick surface such that frozen moisture is generally prevented from adhering to the heat exchange surface whereby said heating system operating in the heating mode will generally operate in heating cycle operation without accumulation of frozen moisture upon the heat exchange surface and thus generally operate without defrost cycle operation.

* * * * *